United States Patent [19]

Rekow

[11] 4,356,953

[45] Nov. 2, 1982

[54] TRAY COVER WITH SUPPORT LEDGES

[75] Inventor: Vernon C. Rekow, St. Paul, Minn.

[73] Assignee: Champion International Corporation, Stamford, Conn.

[21] Appl. No.: 278,162

[22] Filed: Jun. 29, 1981

[51] Int. Cl.[3] ..... B65D 5/44; B65D 5/64

[52] U.S. Cl. ..... 229/34 R; 229/32; 229/43

[58] Field of Search ..... 229/43, 34 B, 34 R, 229/31 FS, 32

[56] References Cited

U.S. PATENT DOCUMENTS

| | | | |
|---|---|---|---|
| 1,930,031 | 10/1933 | Andrews | 229/43 |
| 2,525,268 | 10/1950 | Napier | 229/34 R |
| 2,926,831 | 3/1960 | Strange | 229/32 |
| 3,410,475 | 11/1968 | Wagner | 229/34 R |
| 3,412,921 | 11/1968 | Rekow | 229/32 |
| 3,572,577 | 3/1971 | Dorfman | 229/32 |
| 3,871,570 | 3/1975 | Garmon | 229/32 |
| 3,917,156 | 11/1975 | Bandit | 229/32 |

*Primary Examiner*—Herbert F. Ross
*Attorney, Agent, or Firm*—Evelyn M. Sommer

[57] ABSTRACT

A one-piece tray cover is provided with corner ledges that maintain the cover in an elevated position with respect to the top edges of a bottom tray on which the cover is positioned. The tray cover can also function as a supporting base for the tray bottom. When so used, the cover is inverted with its opening facing upward. The bottom tray is then placed inside the upward facing opening of the inverted tray cover. When used as a support base, the corner ledges serve to support the tray bottom in an elevated manner. The height of the corner ledges is less than the overall height of the tray cover. The corner ledges may be provided with a tapered edge resulting from a back-to-back fold along two non-parallel crease lines.

4 Claims, 12 Drawing Figures

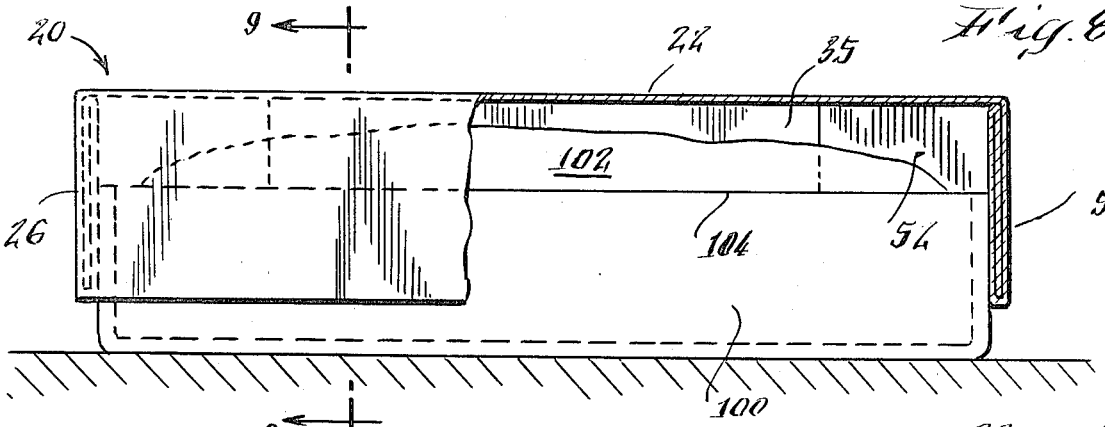
Fig. 8.
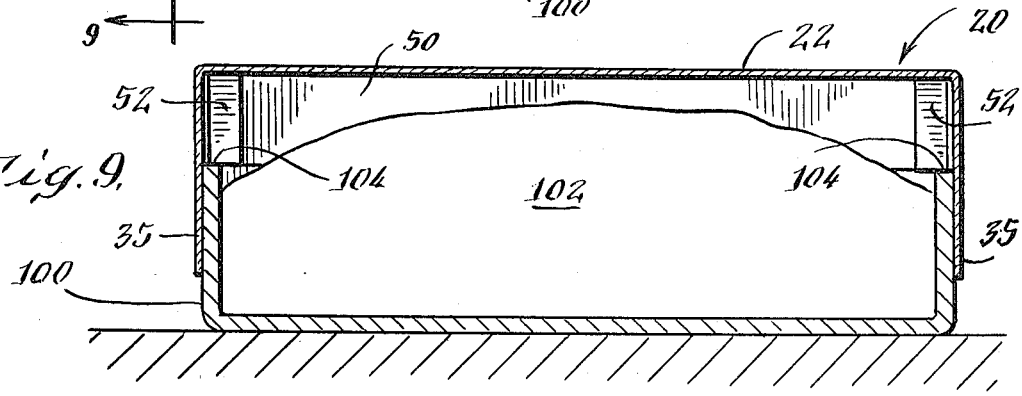
Fig. 9.
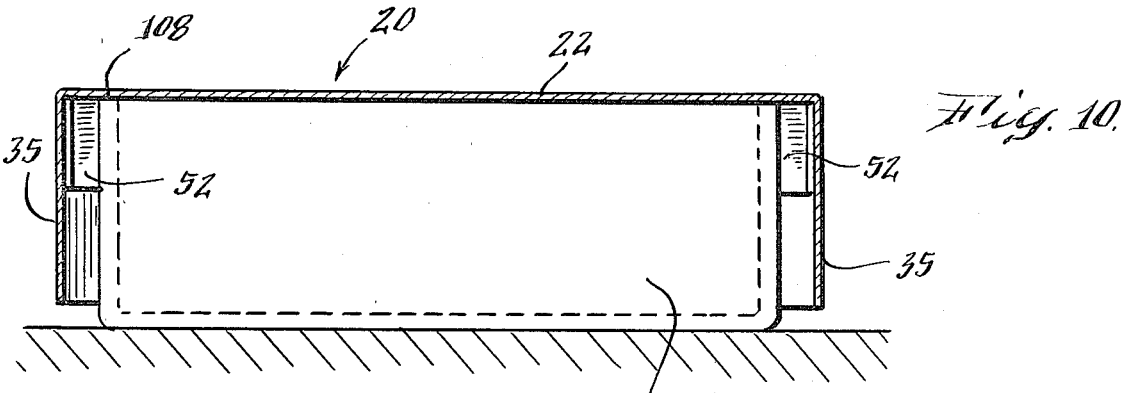
Fig. 10.
Fig. 11.
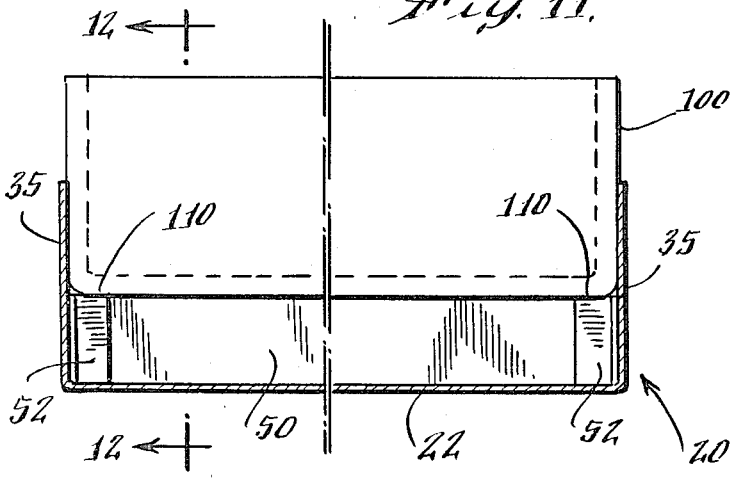
Fig. 12.
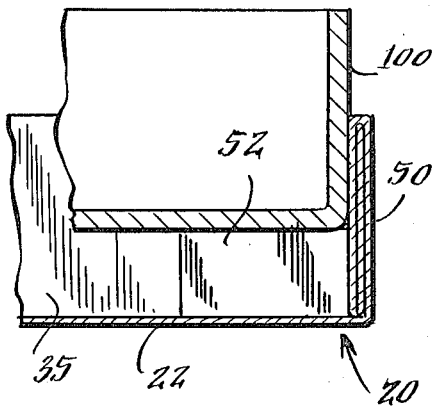

TRAY COVER WITH SUPPORT LEDGES

BACKGROUND OF THE INVENTION

This invention relates to a one-piece tray cover and more particularly to a tray cover having integral support ledges which serve to support the cover in an elevated position above the edges of a corresponding bottom tray.

In the past, trays have been provided with covers that sit flush with the top edges of the tray. In such a configuration, a bottom tray with a cover on it could contain products which were no higher than the tray bottom itself. Additionally, when the covers of such trays were inverted and the trays placed therein, the inverted tray cover/bottom combination was not substantially higher than the height of the tray bottom alone. In fact, the only difference in height between the inverted tray cover/bottom combination and the tray bottom itself was due to the thickness of the material used in the top panel (bottom panel when inverted) of the tray cover.

It would be advantageous to provide a tray cover that would enable the packaging of goods that extend beyond the top edges of the tray bottom. When the tray cover is inverted, with the tray bottom inserted into it, the tray cover should support the tray bottom in an elevated manner, providing an attractive display arrangement.

This invention relates to such a tray cover.

SUMMARY OF THE INVENTION

The tray cover of the present invention is provided with a top panel which serves as a cover for a bottom tray. A pair of opposed side walls and a pair of opposed end walls connecting the side walls are foldably connected to the top panel.

The end wall panels are constructed by folding two hingedly connected rectangular panels back-to-back. The innermost of said panels may be provided with tabs which lock into corresponding notches or indentations in the top panel. The locking engagement of such tabs with notches or indentations serves to maintain the tray in an erect, rectangular configuration. The side wall panels have flaps hingedly connected to the edges thereof which flaps are retained between the back-to-back panels forming the end walls.

The innermost of each end wall panel also has a pair of support ledge wings (formed from end panel extensions) hingedly connected to its opposed edges. Each support ledge wing includes a flap member which when folded back-to-back with respect to the support ledge wing forms a support ledge which rests adjacent to its corresponding side wall and the top panel. The height of each support ledge is less than the height of the side and end walls. Thus, inside each corner of the tray cover and adjacent to the side wall which forms the corner, there exists a ledge, or shelf, which serves to support the tray cover above the edges of a corresponding tray with the top panel in raised relation thereto.

The flap members which are connected to the support ledge wings may each have two non-parallel crease lines to provide a tapered bottom edge to the ledge formed when the flap is folded over in back-to-back relation with the support ledge wing. This construction results in support ledges which exhibit a spring force directed inwardly toward the center of the tray cover. Thus, articles completely filling the area defined by the tray cover are somewhat cushioned as a result of light pressure from the support ledges.

The tray cover can also function as a base for the bottom tray. In such a configuration, the tray cover is inverted and the bottom tray fits therein. The bottom panel of the bottom tray is supported by the support ledges in the corners of the tray cover. The bottom tray is thus supported in raised relation to the top panel (now on the bottom) of the inverted tray cover to form an attractive display arrangement.

BRIEF DESCRIPTION OF THE DRAWINGS

Further objects and advantages of the invention will become apparent from the following description and claims, and from the accompanying drawings, wherein;

FIG. 8 is a side view showing the tray cover of the present invention situated on a bottom tray;

FIG. 9 is a cross-sectional view taken substantially along the plane indicated by line 9—9 of FIG. 8;

FIG. 10 is a cross-sectional view showing the tray cover of the present invention situated on a bottom tray of small enough perimeter to fit within the corner support ledges of the tray cover;

FIG. 11 is a cross-sectional view of an inverted tray cover according to the present invention having a bottom tray situated therein for display purposes;

FIG. 12 is a partial cross-sectional view taken substantially along the plane indicated by line 12—12 of FIG. 11.

DETAILED DESCRIPTION OF THE PREFERRED EMBODIMENT

Figure 4:
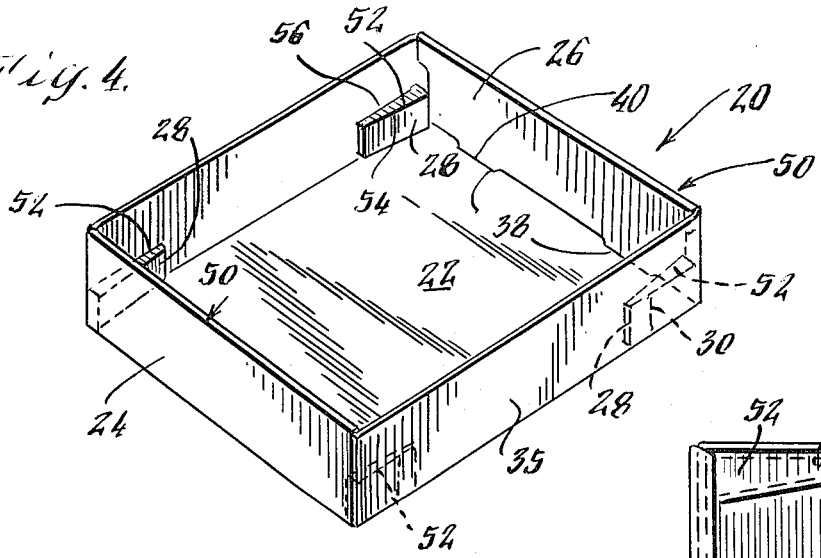

Referring now to the drawings in detail, wherein like numerals indicate like elements throughout the several views, the present invention comprises a substantially rectangular tray cover 20 having end walls 50 and side walls 35 (FIG. 4).

Figure 1:
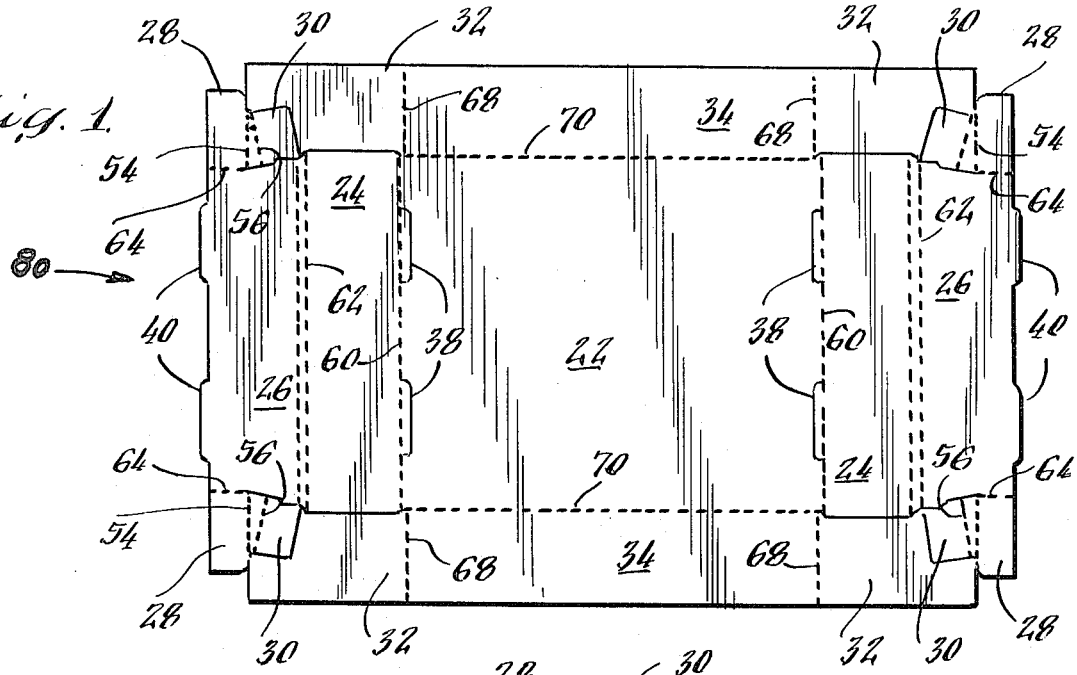
FIG. 1 is a plan view of a blank for forming the tray cover of the present invention.
Figure 2:
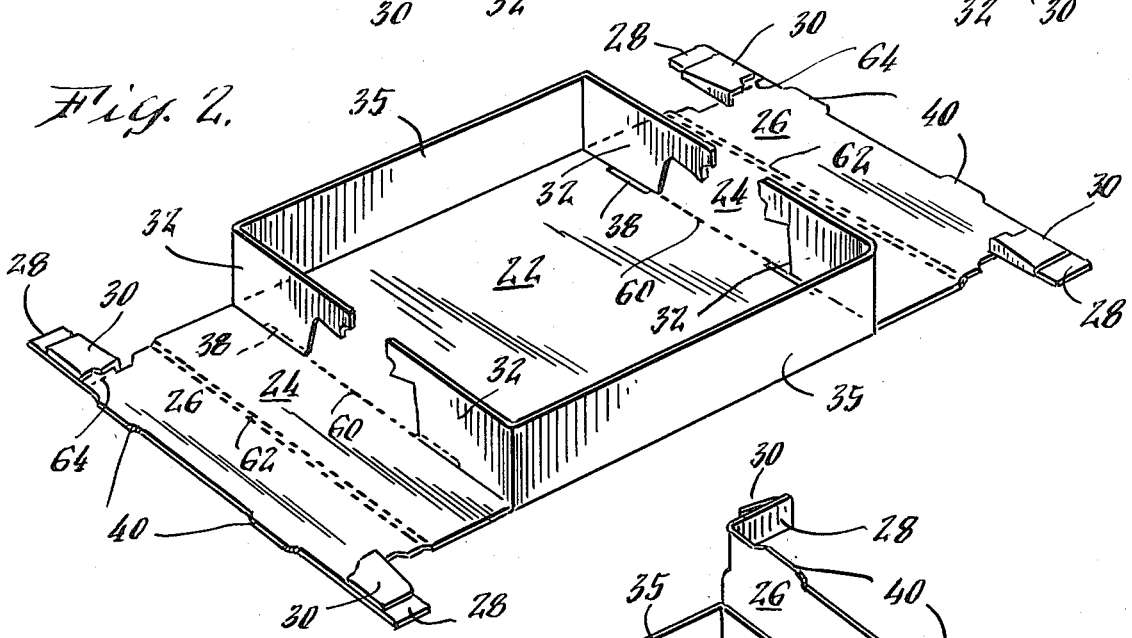
FIGS. 2 through 4 are perspective views illustrating the folding of the blank of FIG. 1 to form the tray cover of the present invention.
Figure 3:
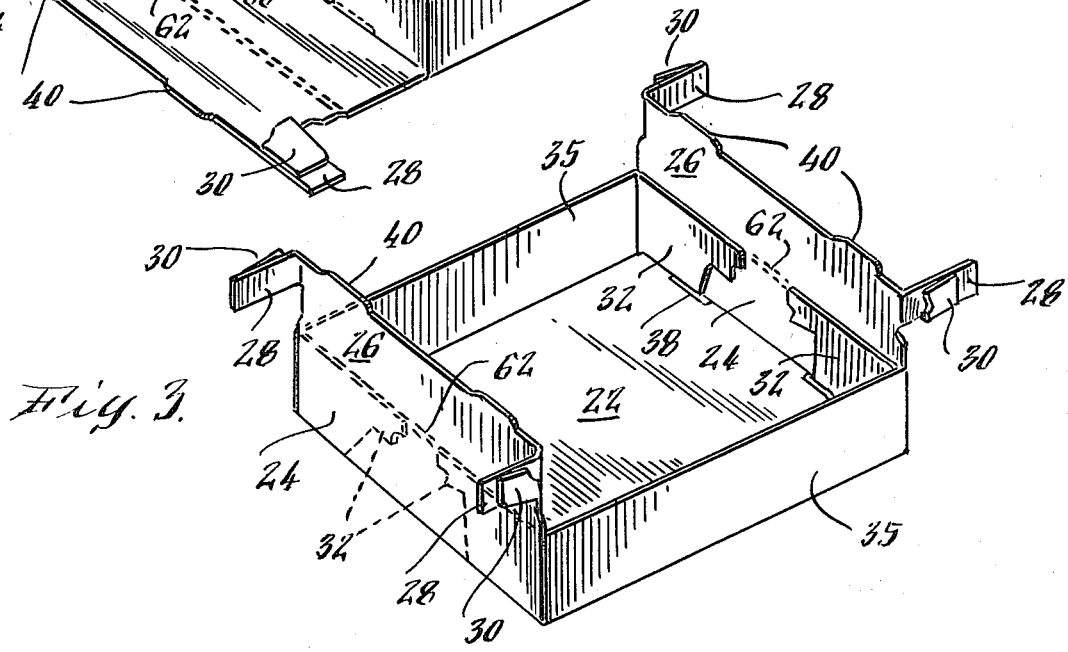

The construction of tray cover 20 can be best understood by referring to the blank 80 shown in FIG. 1 which is folded as shown in FIGS. 2 and 3 to form the tray cover. Upright side walls 35 are formed by folding panels 34 along crease lines 70 to become perpendicular with respect to top panel 22. Panels 34 have flaps 32 hingedly connected to opposing edges thereof. Flaps 32 may be folded 90° along crease line 68 as shown in FIG. 2.

End walls 50 comprise rectangular panels 24 and 26 which are folded along crease lines 62 to be in back-to-back relation with one another. Support ledge wings 28 are hingedly connected to panel 26 at crease line 64.

Flaps 30 are connected to support ledge wings 28 through two crease lines 54 and 56. Crease line 54 is parallel with the edge of wing 28. Crease line 26 is formed at an acute angle with respect to crease line 54 as will be explained in detail below.

As shown in FIG. 3, panel 24 is folded 90° with respect to top panel 22. Flap 30 is folded along crease lines 54 and 56 180° so that it is in back-to-back relation with support ledge wing 28. Support ledge wing 28 is also folded 90° with respect to panel 26. Panel 26 may then be folded 180° downward into back-to-back relation with panel 24. Flaps 32 connected to side panels 34 are sandwiched between back-to-back panels 24 and 26. Thus, end panels 50 provide structural support to tray cover 20 and hold side walls 35 in perpendicular relation to top panel 22.

Notches or indentations 38 are provided at the interface between top panel 22 and end wall panel 24. Tabs 40 are provided on end wall panels 26 to lock into notches or indentations 38.

As shown in FIG. 4, the above-described construction results in a tray 20 having support ledges 52. The tapered shape of support ledges 52 is shown in detail in FIG. 5. The taper results from the nonparallel relation of crease lines 54 and 56 on which flap 30 is folded with respect to support ledge wing 28. Ledge 52 provides the support surface on which tray cover 20 rests when placed on top of a tray bottom. As shown in FIGS. 8 and 9, tray cover 20 is placed on top of tray bottom 100. Tray bottom 100 may have contents 102 which protrude above its top edges 104. Support ledges 52 maintain tray cover 20 in a raised position with respect to tray bottom 100, providing an area into which contents 102 can project without being compressed.

As shown in FIG. 10, a tray bottom 106 of reduced perimeter can also be used with tray cover 20. When such a reduced perimeter tray bottom is used, tray cover 20 fits completely over tray bottom 106 and not in raised relation thereto. Thus, as is clear from FIG. 10, top panel 22 rests directly on top edges 108 of bottom tray 106. Unlike the configuration shown in FIG. 9, support ledges 52 are outside of and do not rest on the top edges of the bottom tray.

Tray cover 20 may also be used as a supporting base for a bottom tray. Such a configuration is shown in FIGS. 11 and 12. When used in this mode, tray cover 20 is inverted and the outside of top panel 22 rests upon a support surface such as a table or the like. Bottom tray 100 is inserted into tray cover 20. The bottom edges 110 of bottom tray 100 are supported by support ledges 52. Thus, bottom tray 100 is supported in raised relation to the supporting surface on which top panel 22 of tray cover 20 sits. The combination of bottom tray 100 and inverted tray cover 20 results in an attractive display arrangement for the contents of the bottom tray.

Figure 5:
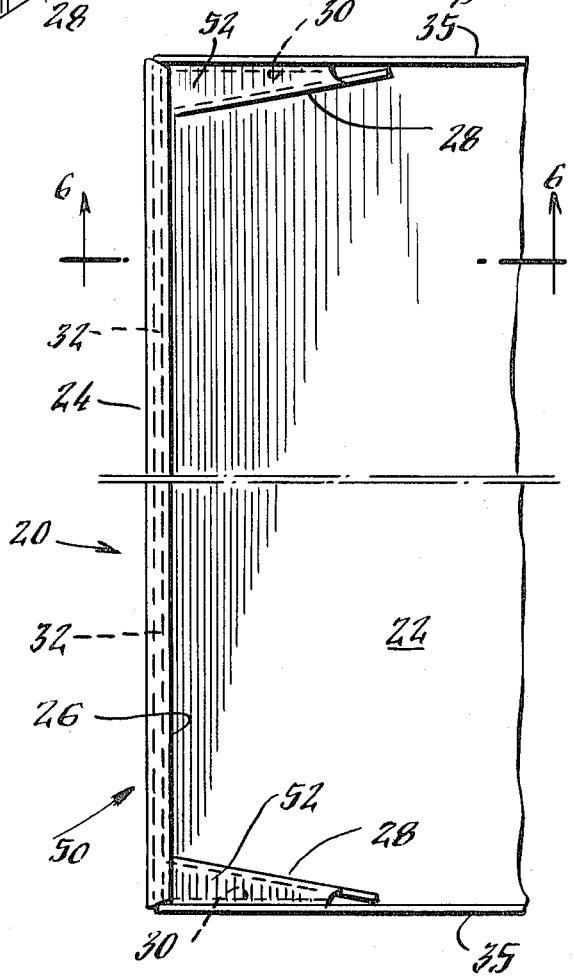
FIG. 5 is an enlarged detail top view of the two of the corners of the tray cover shown in FIG. 4.
Figure 7:
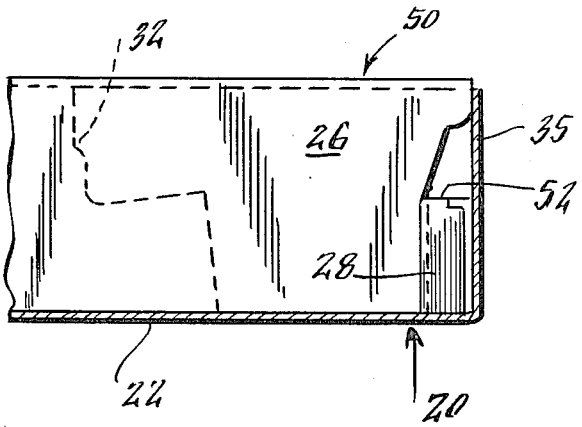
FIG. 7 is a cross-sectional view taken substantially along the plane indicated by the line 7—7 of FIG. 6.
Figure 6:
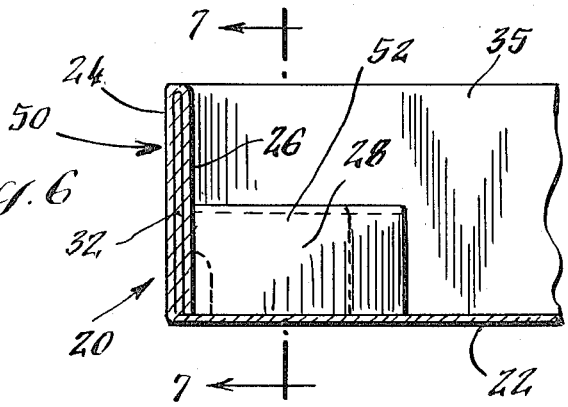
FIG. 6 is a cross-sectional view taken substantially along the plane indicated by line 6—6 of FIG. 5.

The tapered shape of ledge 52 provides a secondary function; namely, padding to provide protection against physical damage to contents of a tray bottom which extend into the raised portion of tray cover 20. A natural tendency of flap 30 to spring out and away from support ledge wing 28 provides a bias against such tray contents. FIGS. 5 through 7 clearly show the relationship between flap 30, support ledge wing 28 and side wall panel 34.

The height of support ledge 52 with respect to side walls 35 will determine the extent to which tray cover 20 is raised above the top edges of a tray bottom. Thus, the extent to which contents protruding from a tray bottom can project into the top cover is determined by the height of support ledges 52. Similarly, the amount of elevation of tray bottom 100 above top panel 22 shown in FIG. 11 is determined by the height of support ledges 52.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined by the appended claims.

What is claimed is:

1. A tray cover for a container or tray comprising:
   - a pair of opposed side walls;
   - a pair of opposed end walls connecting said side walls, said end walls being of substantially the same height as said side walls;
   - each of said side and end walls being foldably connected to a top panel for covering said container or tray;
   - each of said end walls including a pair of panels foldably connected to each other in back-to-back relation; and
   - each of the innermost of said end wall panels having a pair of tapered support leg wings foldably connected to opposed edges thereof, each of said support ledge wings having an edge contacting said top panel and having a height of much smaller dimension then that of said side and end walls, each of said support ledge wings includes a flap member with the height as said ledge wing and having a first crease and a second crease forming an acute angle with said first crease, said flap member being folded along said creases and in back-to-back relation with said support ledge wing to define a tapered ledge adjacent to its nearest side wall and with the apex of said tapered ledge remote from its connected end wall.

2. The cover of claim 1 wherein each of the innermost of said end wall panels includes at least one upwardly facing tab along its top edge received within a notch or indentation formed in said top panel to lock said side and end walls into fixed relation with said top panel.

3. An integral paperboard blank for forming a cover for a container or tray comprising:
   - a first rectangular panel;
   - a pair of second rectangular panels foldably connected along opposed edges of said first rectangular panel;
   - a pair of third rectangular panels foldably connected along the remaining opposed edges of said first rectangular panel, said third rectangular panels having fourth rectangular panels foldably connected along the length thereof;
   - each of said second panels having a pair of opposed panel extension flaps foldably connected thereto; and
   - each of said fourth panels having a pair of edge flaps partially connected along a first crease line perpendicular to the edge thereof opposite said third panel and terminating less than half the width of said fourth panel;
   - said edge flaps including free portions extending from the innermost end of said first crease line and circumscribing the remainder of said side edge flap;
   - said free portions substantially bisected by divergent second and third crease lines, said second crease line extending from the termination of said first line and parallel to said edge of said fourth panel opposite said third panel, the width of said free portions being of equal dimension.

4. The paperboard blank of claim 3 wherein the free portions of said edge flaps containing said third crease lines formed an acute angle with respect to said second crease lines.

* * * * *